US008684629B2

(12) United States Patent
Asplund et al.

(10) Patent No.: US 8,684,629 B2
(45) Date of Patent: Apr. 1, 2014

(54) SEA FLOOR ANCHORING APPARATUS

(76) Inventors: Kyle D. Asplund, Wichita, KS (US); Kenneth Ross Jordan, Andover, KS (US)

( * ) Notice: Subject to any disclaimer, the term of this patent is extended or adjusted under 35 U.S.C. 154(b) by 92 days.

(21) Appl. No.: 13/545,829

(22) Filed: Jul. 10, 2012

(65) Prior Publication Data

US 2013/0058727 A1 Mar. 7, 2013

(51) Int. Cl.
*E02D 5/74* (2006.01)
*E02D 27/52* (2006.01)

(52) U.S. Cl.
USPC ..... 405/224; 405/224.1

(58) Field of Classification Search
CPC ..... E02D 27/52; E02D 17/525; E02D 5/80; E02D 5/801; E02D 7/28
USPC ..... 405/195.1, 203, 205, 207, 208, 224, 405/224.1, 244
See application file for complete search history.

(56) References Cited

U.S. PATENT DOCUMENTS

| | | | | |
|---|---|---|---|---|
| 2,021,014 | A | 11/1935 | Moran | |
| 3,354,659 | A | 11/1967 | Lehmann | |
| 3,519,071 | A * | 7/1970 | Word, Jr. | 166/351 |
| 3,621,910 | A * | 11/1971 | Sanford et al. | 166/335 |
| 3,636,717 | A | 1/1972 | Pogonowski et al. | |
| 3,965,687 | A | 6/1976 | Shaw | |
| 4,055,224 | A * | 10/1977 | Wallers | 175/5 |
| 4,257,721 | A | 3/1981 | Haynes | |
| 4,312,289 | A | 1/1982 | Conrad | |
| 4,347,802 | A | 9/1982 | Hossfeld | |
| 4,558,744 | A | 12/1985 | Gibb | |
| 4,761,096 | A | 8/1988 | Lin | |
| 4,767,240 | A | 8/1988 | Ohkawara et al. | |
| 5,558,469 | A | 9/1996 | Hellerman | |
| 5,887,667 | A | 3/1999 | VanZante et al. | |
| 5,919,005 | A * | 7/1999 | Rupiper | 405/244 |
| 6,223,671 | B1 | 5/2001 | Head | |
| 6,273,645 | B1 | 8/2001 | Hamre | |
| 6,354,767 | B1 | 3/2002 | Jones | |
| 7,563,056 | B2 | 7/2009 | Gambill | |
| 7,736,094 | B1 | 6/2010 | Bianchi et al. | |
| 7,752,989 | B2 | 7/2010 | Paz et al. | |
| 7,775,304 | B2 | 8/2010 | Luo | |
| 7,891,910 | B2 | 2/2011 | Schakenda et al. | |
| 8,157,481 | B1 | 4/2012 | Doyle, Jr. et al. | |
| 2011/0158752 | A1 | 6/2011 | Hitchin | |

FOREIGN PATENT DOCUMENTS

| | | |
|---|---|---|
| CN | 201891113 | 7/2011 |

* cited by examiner

*Primary Examiner* — John Kreck
*Assistant Examiner* — Stacy Warren
(74) *Attorney, Agent, or Firm* — Kenneth H. Jack; Davis & Jack, LLC

(57) ABSTRACT

A sea floor anchoring apparatus including a first and second tube, the second tube extending through the first tube's hollow bore and forming an annulus between the first and second tubes; rotary bearings interconnecting the first and second tubes for rotation of the second tube within the first tube; sand agitating teeth attached to the second tube's lower end; a turbine pump connected to the first and second tubes for, upon the rotation of the second tube, driving the water downwardly through the annulus; and a motor and motor housing assembly further interconnecting the first and second tubes, the motor turning the second tube, the teeth, and the turbine.

15 Claims, 4 Drawing Sheets

SEA FLOOR ANCHORING APPARATUS

FIELD OF THE INVENTION

This invention relates to piers and anchoring systems for installation upon and use at the sea floor or upon the beds of lakes or rivers. More particularly, this invention relates to such anchoring systems which are self-contained and which are adapted for substantially automatic self-anchoring.

BACKGROUND OF THE INVENTION

Posts, piers, and columns are known to be usefully and advantageously mounted or anchored within the sea floor, or upon the floors or beds of lakes or rivers. Such posts, piers, and columns facilitate anchored attachments of ties, chains, and tethers for securing boats and barges. Such posts, piers, and columns also provide foundation support for submerged equipment and structures.

At great depths, such piers and columns are typically difficult to install. The instant inventive anchoring apparatus advantageously automatically self-installs as a sea floor, lake floor, or river bed anchor post, column, or pier by incorporating within and as a part of the column, automatic bore drilling, and vertical positioning and stabilizing structures.

BRIEF SUMMARY OF THE INVENTION

A first structural component of the instant inventive sea floor anchoring apparatus comprises a first tube having a hollow bore, an upper inlet end and a lower outlet end. In operation of the instant invention, the first tube component functions as a post, column, or pier, which may be securely mounted at the sea floor or upon the floor of a lake or river. (All references below to the sea floor are considered to equally apply to and refer to the floors or beds of lakes and rivers.) In the preferred embodiment, the first tube is composed of steel, and the upper end of the first tube is preferably annularly expanded to form a bell shaped or toroidally shaped turbine housing.

A further structural component of the instant inventive sea floor anchoring apparatus comprises a second tube having a hollow bore, an upper outlet end, and a lower inlet end, the second tube preferably being fitted for receipt within and extension through the first tube's hollow bore. Upon such extension, a water passage annulus between the first and second tubes is advantageously formed. In the preferred embodiment, the second tube's lower inlet end presents a plurality of sand and silt agitating teeth which are arrayed about the second tube's lower inlet.

The instant inventive sea floor anchoring apparatus preferably further comprises mounting means which are adapted for positioning the second tube within the first tube, and which facilitate rotation of the second tube with respect to the first tube. In a preferred embodiment, the mounting means comprise a pair of, or upper and lower, rotary bearings, such bearings positioning the second tube concentrically within the first tube, and allowing the second tube to freely rotate within the first tube.

The instant inventive sea floor anchoring apparatus preferably further comprises pump means which are connected operatively to the first and second tubes, the pump means being adapted for, upon rotation of the second tube with respect to the first tube, drawing water into the first tube's upper inlet, and simultaneously driving the water downwardly through the annulus toward the first tube's lower outlet end. Where the first tube is configured, as preferred, to include an expanded turbine housing at its upper end, the pump means preferably comprise a plurality of pitched turbine vanes which are fixedly attached to and extend radially outwardly from the second tube's outer wall, such extension positioning the turbine vanes for orbiting motion within the first tube's expanded annular turbine housing space.

The instant inventive sea floor anchoring apparatus preferably further comprises rotating means which span operatively between the first and second tubes, the rotating means being adapted for impelling or driving the rotation of the second tube with respect to the first tube. Upon such impelled rotation, the sand and silt agitating teeth at the second tube's lower end are rotatably driven and the turbine blades attached to the second tube are simultaneously rotatably turned. In a preferred embodiment of the instant invention, the rotating means comprise a motor housing and battery powered motor combination, such housing and motor being positioned to overlie the first and second tubes. The rotating means preferably further comprise a drive axle extending from the motor housing to the second tube.

In operation of the instant inventive sea floor anchoring apparatus, the agitating teeth at the lower end of the second tube may be initially placed in contact with the sea floor with the entirety of the apparatus held in a substantially vertical orientation. Thereafter, the preferably provided electric motor may be actuated for turning the second tube with respect to the first tube. Upon actuation of rotation, the preferably provided turbine pump means draws and drives sea water downwardly through the annulus between the first and second tubes to emit at the first tube's lower outlet end. Such emitted water washes over and about the second tube's lower end, capturing dislodged sand and silt at and about the rotating agitating teeth. Such water flow progresses inwardly and upwardly through the second tube's lower inlet end, and such water flow advantageously carries dislodged sand and silt upwardly through the bore of the second tube to emit and disburse out of the second tube's upper outlet end. Continuation of such tube rotation, sand and silt agitation, and upward carriage of sand and silt, progressively draws the first tube downwardly into the sea floor, causing the first tube to become securely anchored therein in the manner of a sea floor post, column, or pier.

In the preferred embodiment of the instant invention, the rotating means simultaneously drives a downwardly thrusting propellor which assists in sand and silt agitation and assists in anchoring of the first tube within the sea floor.

Also in the preferred embodiment, buoyancy enhancing means, preferably in the form of an expansible elastic bladder, are provided at the upper end of the apparatus for vertically orienting the apparatus during transit through water toward the sea floor, and for assisting in vertically orienting the apparatus during initial bore forming stages.

The instant inventive sea floor anchoring apparatus preferably further comprises a plurality of pivoting and alternatively inwardly and outwardly articulating legs. Provision of such legs further assists in vertically orienting the apparatus during operation, and such legs advantageously provides counter-torque which resists rotation of the first tube.

Accordingly, objects of the instant invention include the provision of a sea floor anchoring apparatus which incorporates structures as described above, and which arranges those structures in relation to each other in manners described above, for achievement of the functions and benefits described above.

Other and further objects, benefits, and advantages of the instant invention will become known to those skilled in the art upon review of the Detailed Description which follows, and upon review of the appended drawings.

DETAILED DESCRIPTION OF A PREFERRED EMBODIMENT

Figure 1:
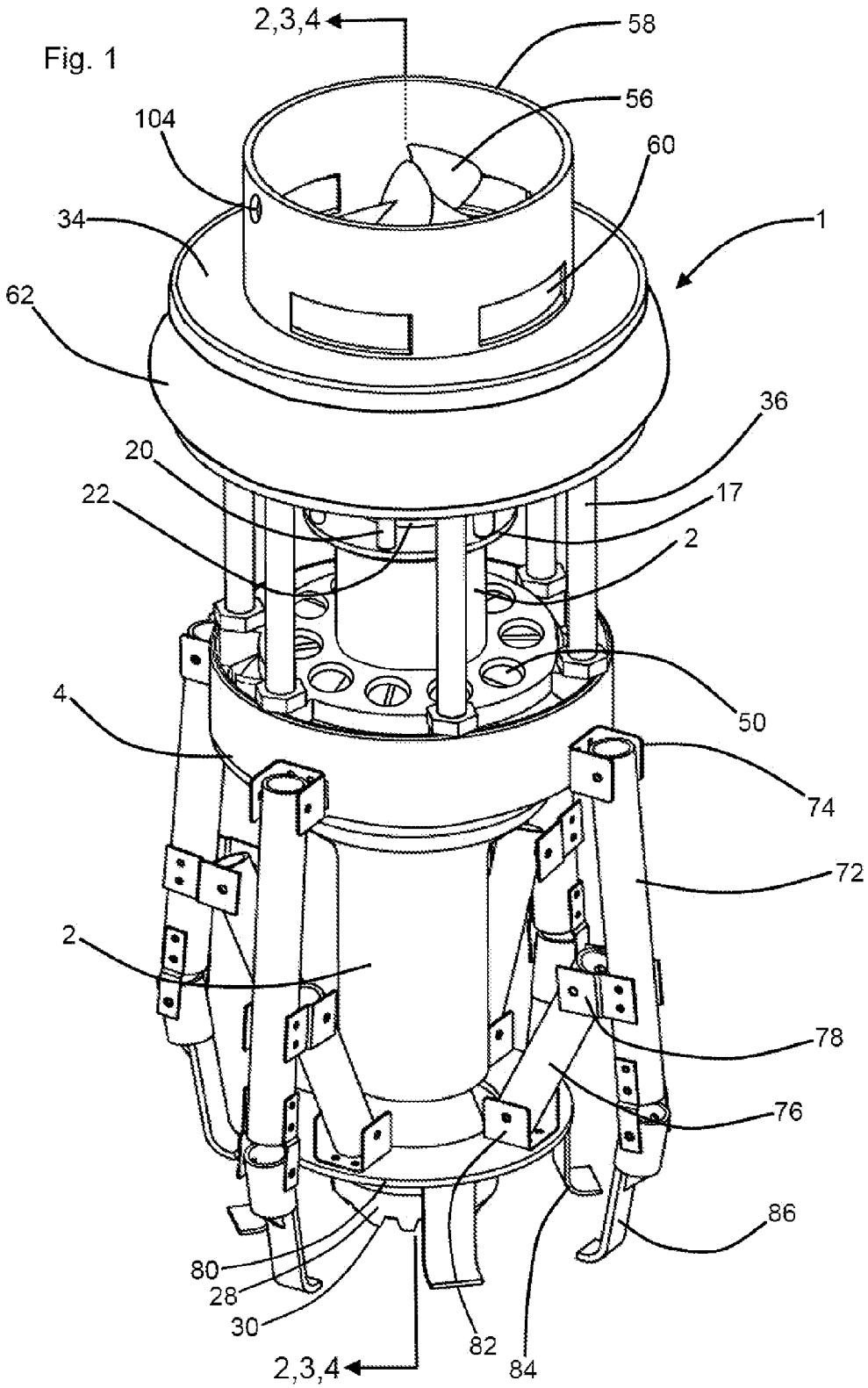
FIG. 1 is a perspective view of a preferred embodiment of the instant inventive sea floor anchoring apparatus.
Figure 2:
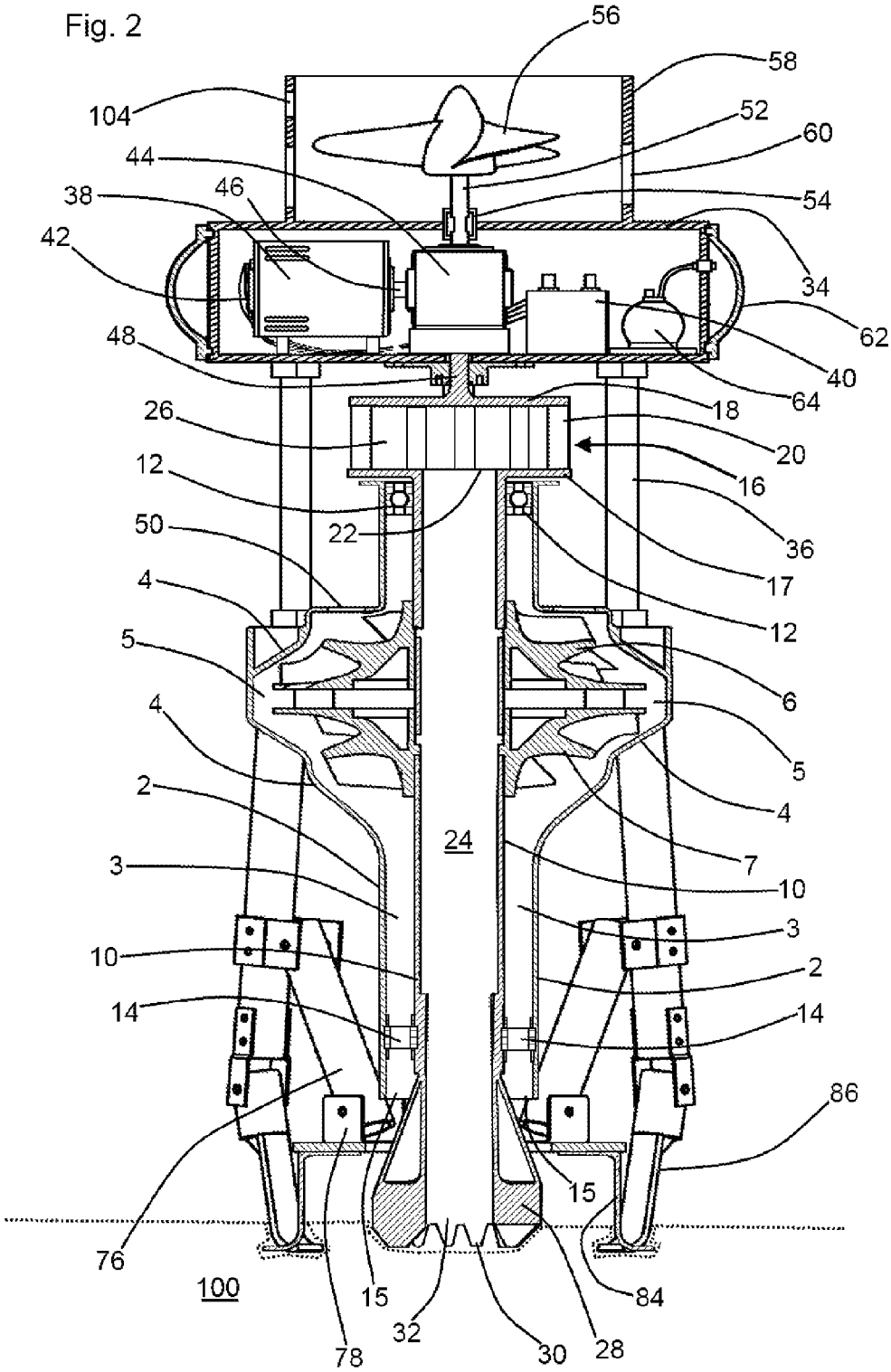
FIG. 2 is a sectional view as indicated in FIG. 1.

Referring now to the drawings, and in particular to FIGS. 1 and 2, a preferred embodiment of the instant inventive sea floor anchoring apparatus is referred to generally by Reference Arrow 1. The apparatus 1 preferably comprises a first tube 2 which, in combination with an axially and internally mounted second tube 10, defines an annulus 3. The upper end of the first tube 2 is preferably radially outwardly expanded to form a turbine housing section 4. Such turbine housing 4 advantageously forms and defines an expanded annulus 5 for housing upper and lower arrays of oppositely pitched turbine vanes 6 and 7, each vane being fixedly attached to and extending radially outwardly from the second tube 10. Upon rotation, vanes 6 draw water downwardly through inlets 50 while the underlying oppositely pitched vane 7 simultaneously drive the water downwardly through annulus 3. The turbine vanes 6,7 and turbine housing 4 components constitute preferred water pumping means. Notwithstanding, other commonly known pumps may be suitably alternatively used and are considered to fall within the scope of the invention.

Referring further simultaneously to FIGS. 1 and 2, first mounting means for positioning the second tube 10 within the first tube 2 are provided, such mounting means preferably comprising upper rotary bearings 12 and lower rotary bearings 14. In the preferred embodiment, the lower rotary bearings 14 are specially adapted for both facilitating rotation of the second tube 10 within the first tube 1, and facilitating downward passage of water through annulus 3 for emission at the second tube's lower outlet 15.

Referring further simultaneously to FIGS. 1 and 2, the upper end of the second tube 10 is preferably specially configured to present a water and debris outlet cage which is referred to generally by Reference Arrow 16. The outlet cage 16 preferably comprises an apertured lower plate 17, an upper plate 18, and a plurality of posts 20 which rigidly interconnect plates 17 and 18. In the preferred embodiment, the central aperture of plate 17 coincides with the upper outlet opening 22 of the second tube 10. In operation of cage 16, water flowing upwardly within the bore 24 of the second tube 10 passes upwardly and outwardly through opening 22 to enter the interior space of cage 16. Thereafter, such water passes radially outwardly through openings 26 which are defined between the posts 20. The posts 20 may be advantageously configured in the manner of the pitched blades of a sirocco fan, allowing such blade configured posts to assist in drawing sea water and sand and silt debris upwardly through bore 24.

Referring further simultaneously to FIGS. 1 and 2, an agitator 28 is preferably fixedly attached to the lower end of the second tube 10, the agitator 28 preferably forming and presenting a plurality of downwardly extending sand and silt agitating teeth 30. By arraying such teeth 30 about the periphery of the lower inlet 32 of the second tube 10, sand and silt which is dislodged by the teeth 30 may be directly drawn inwardly and upwardly through inlet 32 by localized water flows. In the preferred embodiment, the outside diameter of the agitator 28 is slightly greater than the outside diameter of the first tube 10 so that, referring to FIG. 4, a sea floor bore 102 created by downward driving and rotation of agitator 28 may accommodate the outside diameter of the first tube 2.

Referring further simultaneously to FIGS. 1 and 2, rotating means are provided, such means preferably comprising a combination of a hermetically sealed motor housing 34, and a plurality of mounting posts 36 which rigidly support the motor housing 34 over the upper ends of the first and second tubes 2 and 10. As depicted in FIG. 2, the rotating means preferably further comprise a DC electric motor 38, an onboard electric storage battery 40, and a matrix of electrically conductive wires 42 which interconnect the battery 40 and the motor 38. A gear box 44 containing a gear train (not exposed within views) interconnects the motor's rotary power output shaft 46 with a drive axle 48 which is rigidly attached to and extends upwardly from plate 18. Actuation of motor 38 operatively rotates drive axle 48 and rotates the second tube 10 and attached turbine vanes 6 and 7. Rotation of such turbine vanes 6 and 7 draws sea water downwardly through the first tube's water inlets 50 to pass through turbine housing annulus 5 and thence further downwardly through annulus 3 to emit at the first tube's lower outlet 15.

Figure 4:
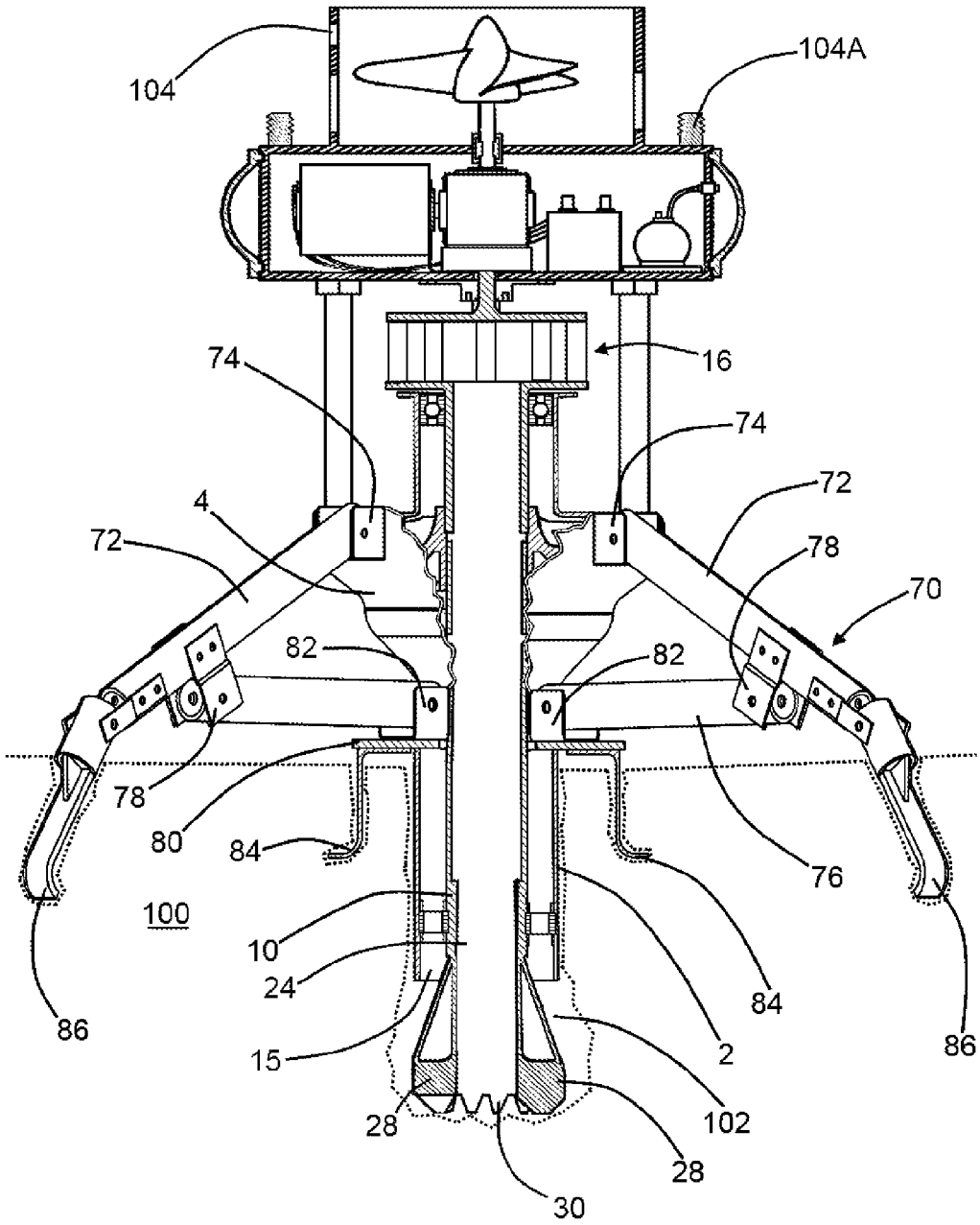
FIG. 4 redepicts FIG. 2, the view of FIG. 4 showing the apparatus extending into and anchored upon the sea floor.

Referring simultaneously to FIGS. 1 and 4, a second rotary power output axle 52 is preferably simultaneously driven by gear train 44, such axle 52 extending upwardly from the motor housing 34 via a water sealed bearing 54. A propellor 56 mounted upon the upper end of the axle 52 preferably has blades which are pitched to provide downward thrust against the apparatus 1 simultaneously with the rotation of the second tube 10 and the agitator 28. Such downward thrust advantageously speeds the progress of sea floor boring through sand and silt agitation, creating a bore 102 within the sea floor 100 into which first tube 2 may extend and become securely anchored.

Referring to all figures, a protective propellor shroud 58 is preferably fixedly attached to and extends upwardly from the upper wall of the motor housing 34, such shroud 58 having a plurality of water inlet ports 60. A tie attachment eye 104 may be conveniently incorporated as a part of the shroud 58.

Figure 3:
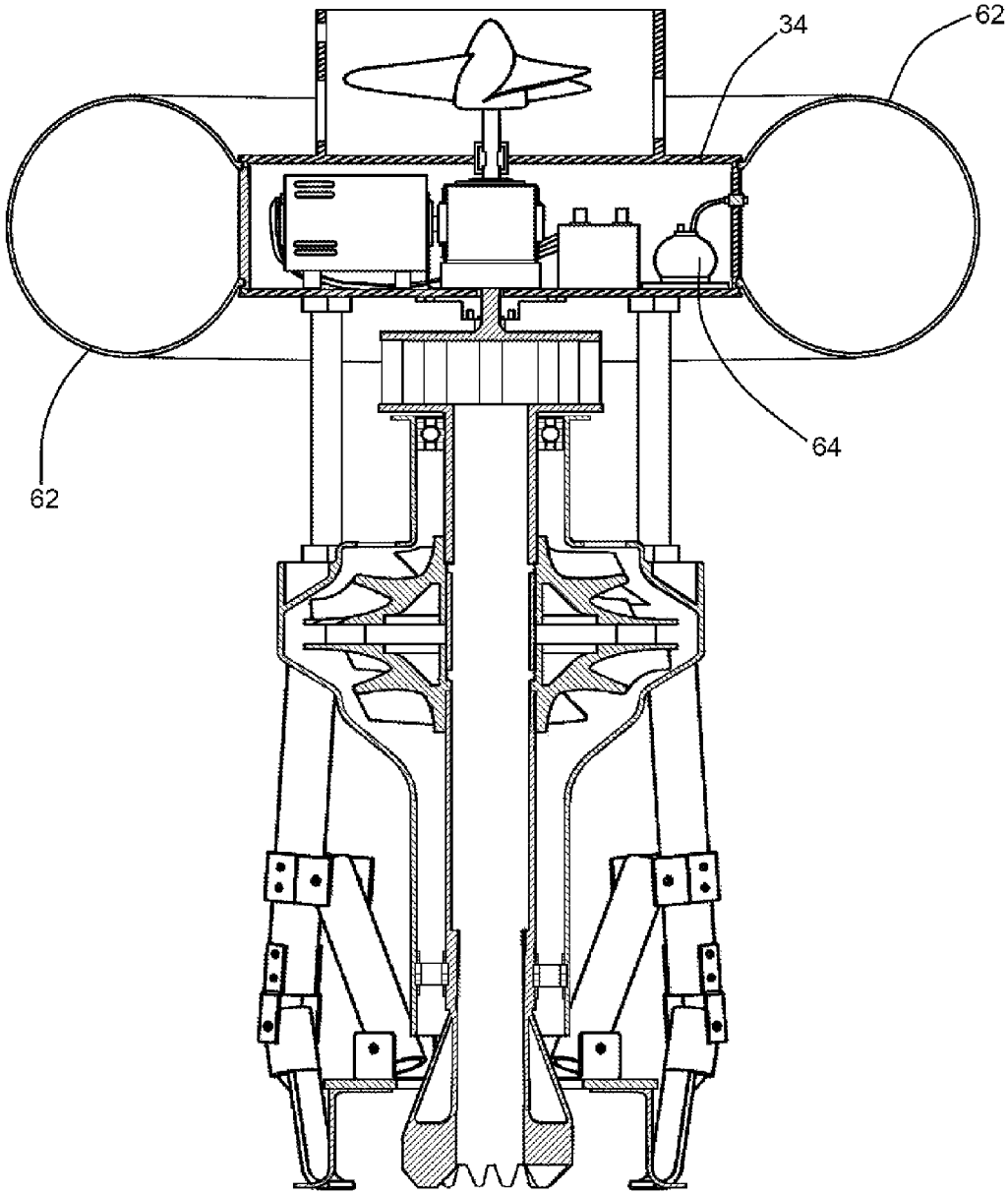
FIG. 3 redepicts FIG. 2, the view of FIG. 3 showing the apparatus's expansible bladder buoyancy enhancing means in its inflated configuration.

It is preferred that the upper end of the apparatus 1 have greater buoyancy than its lower end, the buoyancy differential advantageously biasing the apparatus 1 to assume an upright and vertical orientation. To enhance the apparatus's upper end buoyancy, an elastic and expansible bladder 62 is preferably provided. Such bladder 62, in combination with a bottled source of compressed air 64 within housing 34, may expand from a collapsed configuration, depicted in FIG. 2, to an expanded configuration depicted in FIG. 3. Upon bladder inflation, as depicted in FIG. 3, the upper end of the apparatus 1 advantageously floats in the desired upright and vertical orientation during transit through the water toward the sea floor. Upon initial contact of the apparatus 1 with the sea floor 100, buoyancy provided by bladder 62 advantageously resists toppling of the apparatus.

Referring further to all figures, a plurality of stabilizing legs are preferably provided, such legs being referred to generally by Reference Arrow 70. Each of the legs 70 preferably comprises a cantilevering beam 72 whose proximal end is attached to the turbine housing portion 4 of the first tube 2 by means of pivot joint 74. Each leg 70 preferably further comprises a slide brace 76 whose distal end is pivotally attached to beam 72 by pivot joint 78, and whose proximal end is vertically movably attached to tube 2 by a slide ring 80 and pivot joint 82 combination. Sea floor contacting feet 84 and 86 are preferably provided, feet 84 preferably being fixedly attached to and extending downwardly from slide ring 80, and feet 86 being fixedly attached to the distal ends of the beam members 72.

In articulating operation of the legs 70, feet 84 and 86 may initially contact the sea floor 100 as depicted in FIG. 2. As a combined result of the downwardly directed weight of the apparatus 1, the downwardly directed thrust from propellor 56, and rotation of the agitator 28 against the sea floor 100, the apparatus 1 is progressively downwardly driven into the sea floor 100. Such downward movement and anchoring is accommodated by a sea floor bore 102, the sand and silt contents of which is transported through opening 30, then upwardly through bore to disburse from cage 16.

Upon downward progression of the agitator 28 and tube 2 into such bore 102, slide ring 80 and slide braces 76 progressively move and pivot upwardly, driving the beams 72 and their distal end feet 80 radially outwardly from the first tube 2. Such radially outward motions of the legs 72 advantageously provide enhanced stability to the apparatus 1 while simultaneously providing counter-torque to the first tube 2, preventing rotary motion with respect to the second tube 10.

Referring in particular to FIG. 4, upon mounting of the apparatus 1 within the sea floor 100, as depicted, sand and silt naturally back fills within the bore 102, and the first tube 2 thereby becomes securely anchored upon the sea floor 100 in the manner of a support post, column, or pier. Upon such sea floor anchoring, a tether or tie extending to the water's surface may be attached to attachment eye 104 for secure anchoring of boats, ships, barges, buoys, and the like. Alternatively, the apparatus may be utilized a columnar support for subsea apparatus and equipment. Threaded mounting lugs 104A are representative of such alternative use of the apparatus 1.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

We claim:

1. We claim a water body floor anchoring apparatus comprising:

(a) a first tube having a hollow bore, an upper inlet end, and a lower outlet end;

(b) a second tube having a hollow bore, an upper outlet end, and a lower inlet end, the second tube extending through the first tube's hollow bore and forming an annulus between the first and second tubes;

(c) mounting means interconnecting the first and second tubes, the mounting means permitting rotation of the second tube within the first tube;

(d) an agitator fixedly attached to the second tube's lower end;

(e) pump means connected operatively to one of the tubes among the first and second tubes, the pump means being adapted for, upon the rotation of the second tube within the first tube, driving the water downwardly through the annulus;

(f) rotating means further interconnecting the first and second tubes, the rotating means being adapted for impelling the rotation of the second tube within the first tube; and (g) a propellor, the rotating means being further adapted for rotating the propellor for downward thrust.

2. The water body floor anchoring apparatus of claim 1 wherein the rotating means comprise a motor housing mounted upon the first tube, and wherein the rotating means further comprise an electric motor operatively mounted within the motor housing.

3. The water body floor anchoring apparatus of claim 2 wherein the rotating means further comprise an electric storage battery within the motor housing and a network of electrically conductive wires operatively interconnecting the electric motor and the electric storage battery.

4. The water body floor anchoring apparatus of claim 3 wherein the motor housing overlies the first and second tubes' upper ends.

5. The water body floor anchoring apparatus of claim 4 wherein the pump means comprise a turbine and turbine housing combination.

6. The water body floor anchoring apparatus of claim 5 wherein the annulus has an expanded section, the turbine housing defining said expanded section.

7. The water body floor anchoring apparatus of claim 6 wherein the turbine comprises upper and lower arrays of vanes, said vane arrays being oppositely pitched for respectively downwardly drawing and downwardly driving the water.

8. The water body floor anchoring apparatus of claim 7 wherein the arrays of vanes are fixedly attached to the second tube and wherein the first tube comprises the turbine housing.

9. The water body floor anchoring apparatus of claim 2 wherein the motor housing is hermetically sealed.

10. The water body floor anchoring apparatus of claim 9 further comprising buoyancy enhancing means connected operatively to the motor housing.

11. The water body floor anchoring apparatus of claim 10 wherein the buoyancy enhancing means comprise an expandable air bladder.

12. The water body floor anchoring apparatus of claim 11 wherein the buoyancy enhancing means further comprise a compressed air vessel and air conduit combination, said combination being connected operatively to the expandable bladder.

13. The water body floor anchoring apparatus of claim 1 further comprising a plurality of stabilizing legs, each stabilizing leg being fixedly attached to the first tube.

14. The water body floor anchoring apparatus of claim 13 wherein the stabilizing legs' fixed attachments comprise a plurality of pivot joints, said joints adapting the stabilizing legs for alternative radially outward and radially inward extensions and retractions.

15. The water body floor anchoring apparatus of claim 1 wherein the agitator comprises a plurality of downwardly extending sand and silt contacting teeth, said teeth being arrayed radially about the second tube's lower inlet end.

* * * * *